US012565893B2

(12) United States Patent
Hunchman et al.

(10) Patent No.: US 12,565,893 B2
(45) Date of Patent: Mar. 3, 2026

(54) REVERSING POLARITY OF A PUMP ON FAILURE, AND APPLICATIONS THEREOF

(71) Applicant: ZOELLER PUMP COMPANY, LLC, Louisville, KY (US)

(72) Inventors: Anthony Scott Hunchman, Floyds Knobs, IN (US); William Andrew Dickerson, Louisville, KY (US)

(73) Assignee: ZOELLER PUMP COMPANY, LLC, Louisville, KY (US)

( * ) Notice: Subject to any disclaimer, the term of this patent is extended or adjusted under 35 U.S.C. 154(b) by 0 days.

(21) Appl. No.: 18/435,774

(22) Filed: Feb. 7, 2024

(65) Prior Publication Data

US 2024/0410373 A1 Dec. 12, 2024

Related U.S. Application Data

(60) Provisional application No. 63/471,666, filed on Jun. 7, 2023.

(51) Int. Cl.

| | |
|---|---|
| ***F04D 15/00*** | (2006.01) |
| ***F04D 7/04*** | (2006.01) |
| ***F04D 13/06*** | (2006.01) |
| ***F04D 29/22*** | (2006.01) |

(52) U.S. Cl.

CPC ..... *F04D 15/0077* (2013.01); *F04D 7/045* (2013.01); *F04D 13/06* (2013.01); *F04D 15/005* (2013.01); *F04D 29/2283* (2013.01); *F04D 29/2288* (2013.01)

(58) Field of Classification Search

CPC ..... F04D 15/0077; F04D 7/045; F04D 13/06; F04D 15/005; F04D 29/2283; F04D 29/2288

See application file for complete search history.

(56) References Cited

U.S. PATENT DOCUMENTS

| | | | | |
|---|---|---|---|---|
| 3,558,255 | A | 1/1971 | Rose | |
| 6,379,109 | B1 * | 4/2002 | Senior, Jr. ..... | F04D 15/0088 210/219 |
| 11,635,080 | B1 * | 4/2023 | Tofte ..... | F04D 15/0209 416/63 |
| 2005/0051897 | A1 | 3/2005 | Hsu | |
| 2005/0061897 | A1 | 3/2005 | Lipowski | |

(Continued)

OTHER PUBLICATIONS

International Search Report and Written Opinion directed to related International Application No. PCT/US 24/33001, mailed Sep. 23, 2024; 10 pages.

(Continued)

*Primary Examiner* — Bryan M Lettman

(74) *Attorney, Agent, or Firm* — Sterne, Kessler, Goldstein & Fox, P.L.L.C.

(57) ABSTRACT

A pump is provided that reverses polarity of the current to reverse the rotation of an impeller on failure to clear objects that may be blocking the impeller. The pump may have an impeller configured to move fluid through the pump in a common direction regardless of which way the impeller rotates, an electric motor configured to drive the impeller, and a controller configured to detect potential failure of the impeller to rotate, and, in response to detection of the potential failure, reverse polarity of current to the electric motor to reverse rotation of the impeller.

20 Claims, 4 Drawing Sheets

(56) References Cited

U.S. PATENT DOCUMENTS

| | | | | |
|---|---|---|---|---|
| 2006/0198735 | A1* | 9/2006 | Iijima | F04C 28/28 417/44.1 |
| 2013/0108479 | A1* | 5/2013 | Branecky | F04D 15/0088 417/280 |
| 2021/0148365 | A1* | 5/2021 | Ulliman | F04D 29/4293 |
| 2022/0145890 | A1 | 5/2022 | Wang | |
| 2022/0325724 | A1* | 10/2022 | Dumonceaux | F04D 15/0022 |
| 2023/0011208 | A1 | 1/2023 | Tanaka et al. | |

OTHER PUBLICATIONS

Tech Tip: 3-Phase Motor Reversing, AutomationDirect.com, obtained online Sep. 10, 2024 (Sep. 10, 2024).

* cited by examiner

REVERSING POLARITY OF A PUMP ON FAILURE, AND APPLICATIONS THEREOF

CROSS-REFERENCE TO RELATED APPLICATIONS AND INCORPORATION BY REFERENCE

The present application claims the benefit of U.S. Provisional Patent Appl. No. 63/471,666, filed Jun. 7, 2023, which is incorporated herein by reference in its entirety.

BACKGROUND

It is becoming increasingly important to use pumps to provide adequate drainage for both commercial and residential uses. As the number of locations and purposes for which pumps are installed increases, the number of pump types has also increased. Examples of pump types include sump pumps, effluent pumps, sewage pumps, grinder pumps, and etc.

The key to any type of pump is proper drainage. If an object that the pump is not designed for gets into the fluid, it block or otherwise impair rotation of a pump's impeller. If a pump's impeller is not rotating properly, the pump may fail to drain properly.

SUMMARY

According to an embodiment, a pump is provided that reversing polarity on failure pump to clear objects that may be blocking the impeller. The pump includes an impeller, an electric motor, and a controller. The impeller is configured to move fluid through the pump in a common direction regardless of which way the impeller rotates. The electric motor configured to drive the impeller. Finally, the controller configured to detect potential failure of the impeller to rotate, and, in response to detection of the potential failure, reverse polarity of current to the electric motor to reverse rotation of the impeller.

System, device, and computer program product aspects are also disclosed.

Further features and advantages, as well as the structure and operation of various aspects, are described in detail below with reference to the accompanying drawings. It is noted that the specific aspects described herein are not intended to be limiting. Such aspects are presented herein for illustrative purposes only. Additional aspects will be apparent to persons skilled in the relevant art(s) based on the teachings contained herein.

BRIEF DESCRIPTION OF THE DRAWINGS

The accompanying drawings are incorporated herein and form a part of the specification.

In the drawings, like reference numbers generally indicate identical or similar elements. Additionally, generally, the left-most digit(s) of a reference number identifies the drawing in which the reference number first appears.

DETAILED DESCRIPTION

Figure 1:
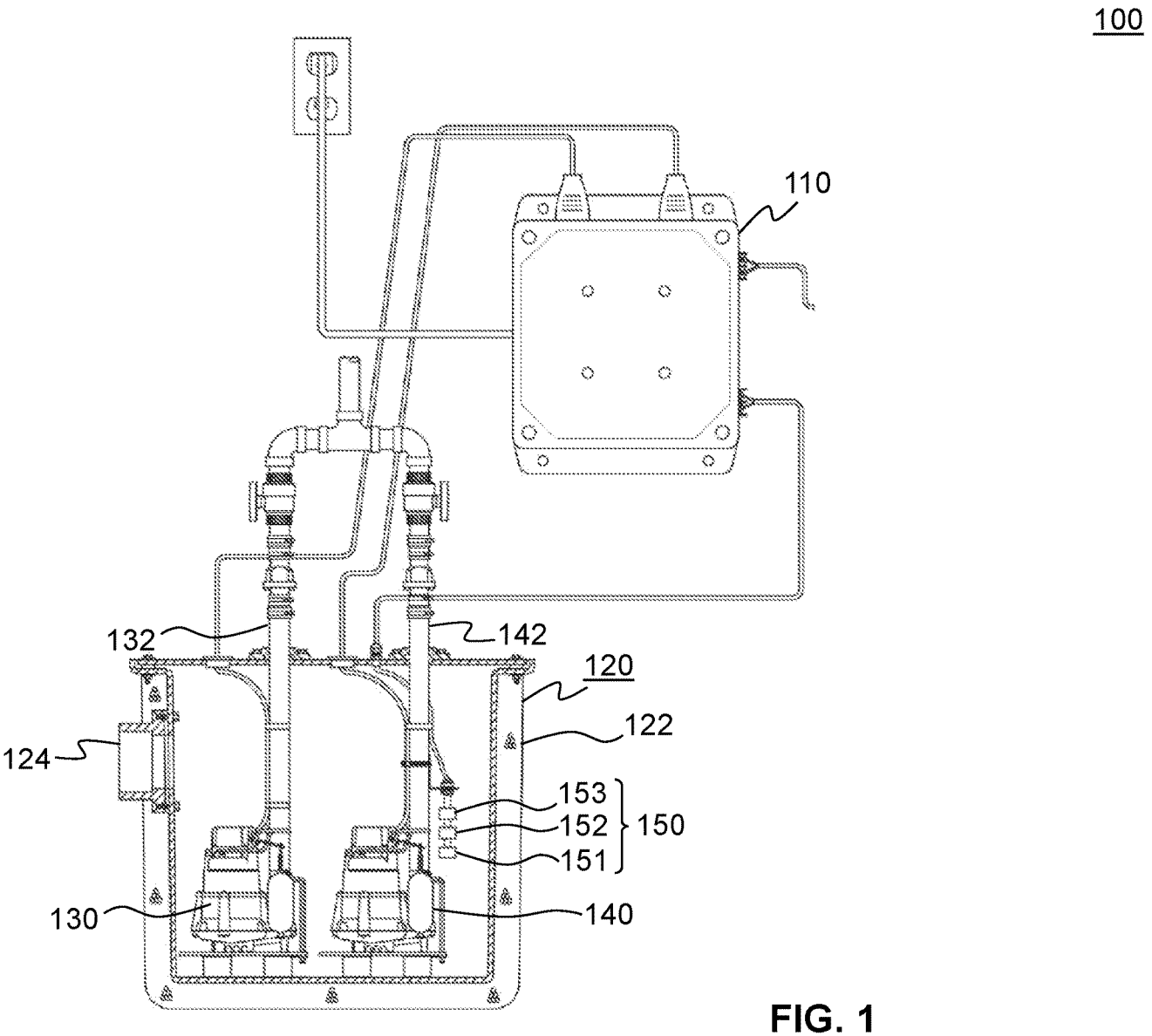
FIG. 1 is a front view of a pump, according to some embodiments.

FIG. 1 is a front view of a pump 100, according to some embodiments. A pump 100 may be a sewage pump with a grinder. A grinder pump is a device that grinds up solid waste suspending in flowing and pumps it, typically to a sewer system where it will ultimately be delivered to a central treatment facility or a septic tank. A grinder pump reduces the risk of clogs, backups, and overflows in the sewer system, as it breaks down solid waste into fine particles that can flow easily through small-diameter pipes. A grinder pump may be used in areas where gravity sewers are not feasible or cost-effective, such as low-lying, hilly, or rocky terrain, or where conventional septic systems are not suitable or reliable. In some embodiments, the pump 100 may be other types of pumps (e.g., sump pumps, effluent pumps etc.) In some embodiments, the pump 100 may be a type of pump without a grinder.

The pump 100 may include a controller 110 and a pump assembly 120. The controller 110 and the pump assembly 120 are examples of elements of the pump 100. In some embodiments, the pump 100 may be composed of different elements. In some embodiments, some elements of the controller 110 or pump assembly 120 may be integrated into a single unit.

The controller 110 may control elements of pump assembly 120. The controller 110 may be a control panel hardwired to an AC power source. The controller 110 accepts inputs from the pump assembly 120 or from the user to control the elements of the pump assembly 120. Examples of controls performed by the controller 110 may include activation, stop instructions, reversal instructions, of impellers in the pump assembly 120 etc. The controller 110 may be configured to detect potential failure of the impeller of the pump 100 to rotate, and, in response to detection of the potential failure, reverse polarity of current to the electric motor of the pump 100 to reverse rotation of the impeller. The motor may drive the impeller and grinder on a single shaft. Thus, when the motor reverses rotation, not only does the impeller reverse its rotation, but the grinder does too. The details of control performed by the controller 110 are explained below with reference to the flowchart in FIG. 4.

The pump assembly 120 may include a reservoir 122, an inlet 124, a first pump unit 130, a second pump unit 140, a stop float 151, a start float 152, and a lag float 153 (also collectively referred to as floats 150). The reservoir 122 may be a container for storing the fluid that flows in from the inlet 124. The inlet 124 is a pipe connected to reservoir 122 and directs incoming fluid from outside to the reservoir 122.

The first pump unit 130 may have a discharging pipe 132, a motor, a grinder, and an impeller. The discharging pipe 132 may be a pipe for discharging fluid pumped by the pump unit 130 to the outside. The motor is an electronic motor and may drive the grinder and the impeller to pump fluid in the reservoir 122 to the discharging pipe 132. The motor may be a single-phase motor or a three-phase motor. The impeller may be configured to move fluid through the pump unit 130 in a common direction regardless of which way the impeller rotates. A direction of the rotation of the impeller may be reversed by the controller 110 if there is a potential failure with the rotation of the impeller of the first pump unit 130. If the motor is the single-phase motor, polarity of current to the motor may be reversed to reverse the direction of the rotation of the impeller. If the motor is the three-phase motor, at least two phases of three phases of the current of the motor may be switched to reverse the direction of the rotation of the impeller. Details of the impeller are explained below by referring to FIG. 2.

The second pump unit 140 may also have a discharging pipe 142, a motor, a grinder, and an impeller. The mechanical configuration of the second pump unit 140 may be substantively similar to that of the first pump unit 130. The second pump unit 140 may be installed as a backup for when there is a potential failure with the rotation of the first pump unit 130.

The floats 150 may be the floats activate fluid detection sensors by changing height in response to the fluid level in the reservoir 122. The fluid detection sensors may be normally-open float switches. Thus, if fluid level reaches to one of the floats, the sensor changes an output from "off" to "on." The fluid detection sensors may be installed inside the floats 150. The fluid detection sensors in the float may be activated when the fluid level reaches a level that displaces the posture of the floats 150. As such, the fluid detection sensors may be positioned to detect a quantity of fluid in the reservoir 122 that the pump 100 is configured to evacuate. The controller 110 may change the operation of the first pump unit 130 or the second pump unit 140 according to the output of the fluid detection sensor.

The floats 150 may be installed in order of decreasing height: the stop float 151, the start float 152, and the lag float 153. The stop float 151 may be a float to detect a timing to stop rotation of the motor(s) of the first pump unit 130 or the second pump unit 140. The start float 152 may be a float to detect a timing to start rotation of the motor of the first pump unit 130. The lag float 153 may be a float to detect a timing to start rotation of the motor of the second pump unit 140. The lag float 153 may also be an alarm float to detect a timing to signal an alarm. The number of the floats 150 is not limited to three; for example, a separate float may be placed to detect the alarm timing.

Figure 2B:
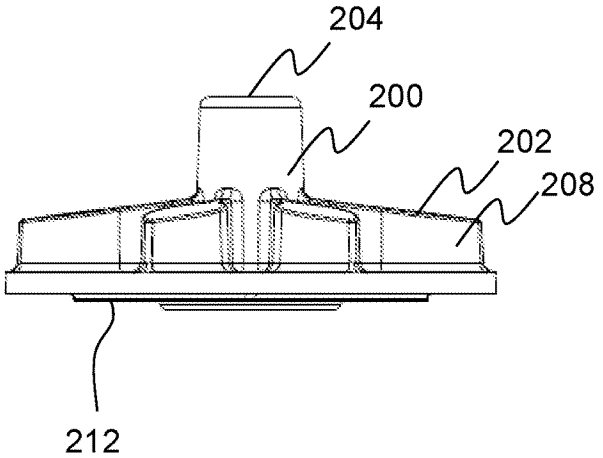
FIG. 2B is a side view of the impeller, according to some embodiments.
Figure 2D:
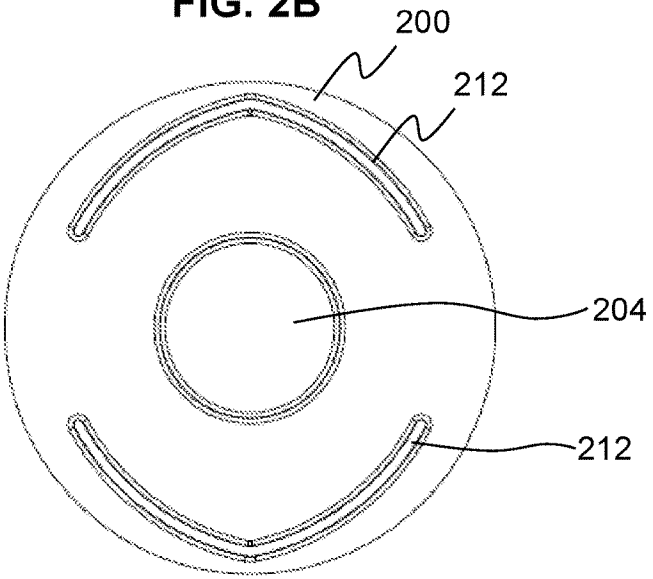
FIG. 2D is a bottom view of the impeller, according to some embodiments.
Figure 2A:
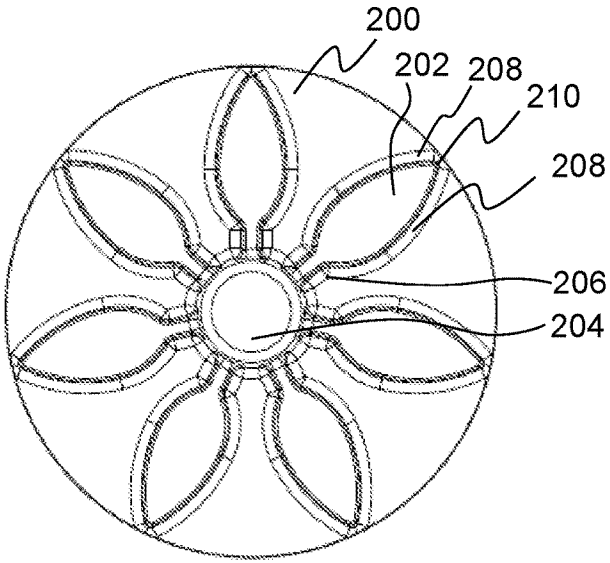
FIG. 2A is a top-down view of an impeller, according to some embodiments.

FIG. 2A is a top-down view of an impeller 200, according to some embodiments. An impeller 200 may be an impeller installed in a lower side of the first pump unit 130 and the second pump unit 140. The impeller 200 may have a blade 202 to push fluid upward. The impeller 200 may have a plurality of the impellers 200. A shaft hole 204 may be provided in a center of the impeller 200. A shaft may be inserted into the shaft hole 204. The shaft may also be inserted into the hole in the grinder cutter unit to rotate the impeller 200 and the grinder cutter in the same direction and at the same speed. The blade 202 may have a neck portion 206 that rises in a straight line from the shaft hole 204 and a curved portions 208 that are walls and bulge symmetrically from the neck portion and then forms a vertex 210 on a center line connecting the center of the shaft hole 204 and the neck portion 206. As the impeller spins, it creates a low-pressure zone at its center and a high-pressure zone at its outer edge. This pressure difference causes the fluid to flow from the inlet of the pump to the outlet, where it is discharged at a higher speed and pressure. Thus, blade 202 can push fluid upward regardless of which direction impeller 200 rotates because fluid can be pushed by the blade 202 to the same direction no matter which direction the fluid hits the blade 202.

Figure 2C:
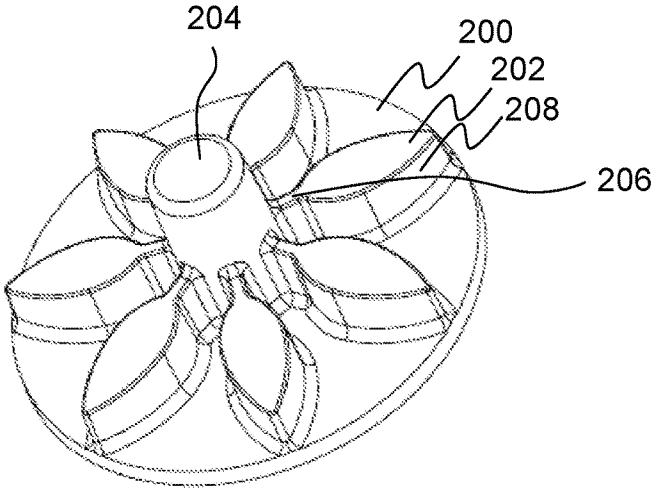
FIG. 2C is a perspective view of the impeller, according to some embodiments.

FIG. 2B is a side view of the impeller 200, according to some embodiments. FIG. 2C is a perspective view of the impeller 200, according to some embodiments. As shown in FIGS. 2B and 2C the blade 202 may have a predetermined height thickness (e.g., half-inch) and slope downward toward the end of impeller 200. The impeller 200 may have a vane 212 on the bottom surface of the impeller 200.

FIG. 2D is a bottom view of the impeller 200, according to some embodiments. As shown in FIG. 2D, the vane 212 may have the outline of two curves joined in a V shape with a radius of curvature smaller than the outline of the impeller 200. The impeller 200 may have multiple vanes 212.

Figure 3:
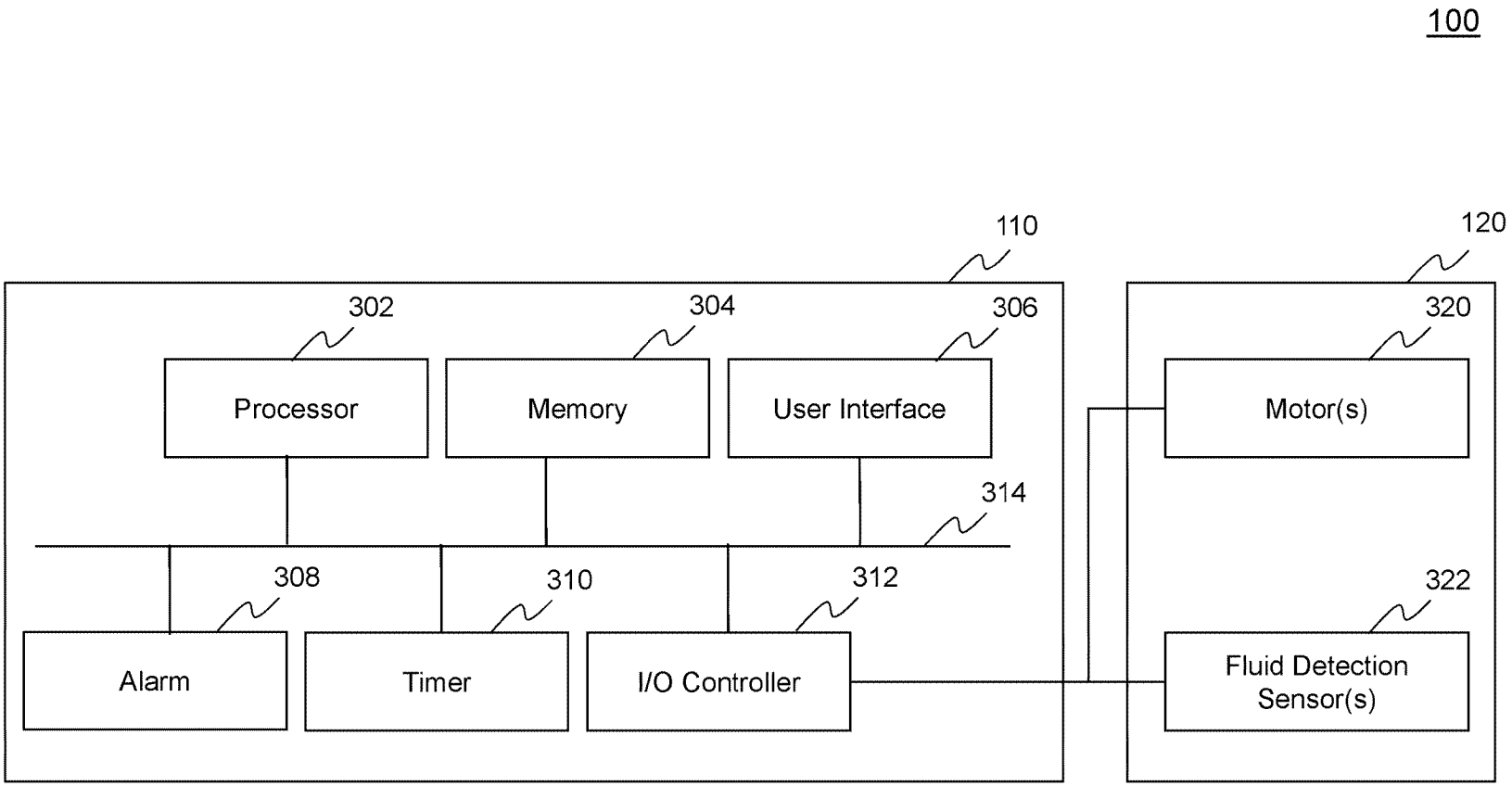
FIG. 3 is a block diagram of a pump, according to some embodiments.

FIG. 3 is a block diagram of a pump 100, according to some embodiments. The controller 110 may have a processor 302, a memory 304, a user interface 306, an alarm 308, a timer 310, and an input/output (I/O) controller 312, all connected by a communication bus 314.

The processor 302 may be a processor for controlling other components of the controller 110. The processor 302 may be a micro-computer or other control circuit. The processor 302 may be a central processing unit, a microcontroller, or a System-on-a-Chip (SoC).

The memory 304 may be a memory for storing instructions executed by the processor 302. The memory may store values for the control of the pump 100. The memory 304 may include a non-transitory computer readable medium.

The user interface 306 may be an interface that exchanges input and output with the user. The user interface 306 may include a display for displaying information to the user. The user interface 306 may include buttons to accept input from the user. The user interface 306 may include a universal serial bus (USB) port to output values to a user-provided USB memory stick or to read settings from the USB memory stick. The user interface 306 may be remote on a separate device. For example, an installer can have the user interface 306 and port it in to make diagnostic and configuration changes.

The alarm 308 alarms in response to an operating status of the pump 100. The alarm 308 may include a speaker. The alarm 308 may include a light. The alarm 308 may report different types of conditions by varying sound and light patterns. The alarm 308 may be activated, for example, in the following situations: high-fluid level (e.g. in response to an output signal from the fluid detection sensor of the lag float 153), failure of the first pump unit 130 or the second pump unit 140, stuck of the floats 150, overload of the first pump unit 130 or the second pump unit 140, and overheat of the first pump unit 130 or the second pump unit 140.

The timer 310 may measure the time related to the operation of the first pump unit 130 or the second pump unit 140. The timer 310 may count the duration of a pump cycle of the pump unit 130 or pump unit 140. The pump cycle is a cycle that refers to the period of time from when the motor (impeller) of the first pump unit 130 or the second pump unit 140 starts to rotate until it stops or reverses rotation. The processor 302 may be configured to detect the potential failure when the timer detects that the impeller of the pump assembly 120 has been continuously rotating for a predetermined time.

The input/output (I/O) controller 312 may exchange I/O signals with components in the pump assembly 120. A signal that I/O controller 312 receives from pump assembly 120 may be an output of fluid detection sensors 322 in the floats 150. A signal that I/O controller transmits to pump assembly 120 may be a driving signal to motors 320 of the first pump unit 130 or the second pump unit 140. The I/O controller 312 or the processor 302 may be configured to detect the potential failure based on a signal from the fluid detection sensor.

Figure 4:
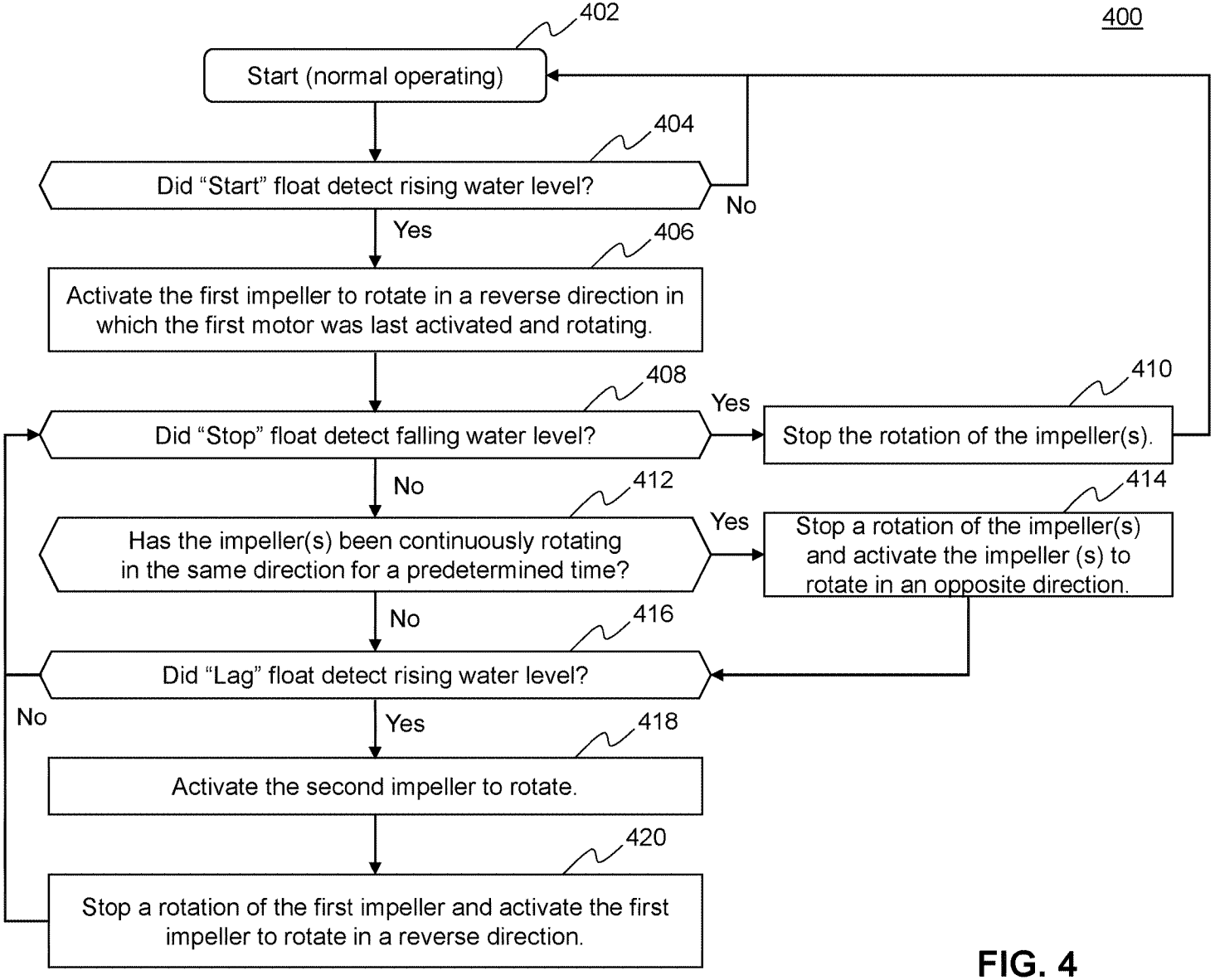
FIG. 4 is a flowchart for a method for controlling a pump, according to some embodiments.

FIG. 4 is a flowchart for a method 400 for controlling a pump, according to some embodiments. Method 400 can be performed by the processor 302, the I/O controller 312 or any other processing logic that can comprise hardware (e.g., circuitry, dedicated logic, programmable logic, microcode, etc.), software (e.g., instructions executing on a processing device), or a combination thereof. It is to be appreciated that not all steps may be needed to perform the disclosure provided herein. Further, some of the steps may be performed simultaneously, or in a different order than shown in FIG. 4, as will be understood by a person of ordinary skill in the art.

In 402, the pump 100 may start operating. The pump 100 starting operation may mean that power has been supplied to controller 110, pump assembly 120, and their components. This state may be recognized as the normal operating state.

In 404, the controller 110 may determine whether the start float 152 detected rising fluid level based on the output from the fluid detection sensor of the start float 152. The controller 110 may determine that the start float 152 detected rising fluid level when the output from the fluid detection sensor of the start float 152 changed from "off" to "on." In 404, the controller may also determine whether the stop float 151 has detected rising fluid level based on the output from the fluid detection sensor of the stop float 151 in addition to determining whether the start float 152 detected rising fluid level.

In 406, if the controller 110 may determine that the start float 152 detected the rising fluid level, the controller 110 may activate the first impeller, the impeller 200 of the first pump unit 130, to rotate in a reverse direction in which the first impeller was last activated and rotating. The fact that the start float 152 has detected the fluid level may mean that a certain amount of fluid has flowed into the reservoir 122 from the inlet 124. Therefore, in order to discharge the fluid, the controller 110 may rotate the impeller 200 of the first pump unit 130. Also, by rotating the first impeller in the reverse direction, foreign matter (e.g., debris, etc.) entangled or clogged in the first impeller 200 during the previous pump cycle can be cleared from the first impeller.

In 408, the controller 110 may determine whether the stop float 151 detected rising fluid level based on the output from the fluid detection sensor of the stop float 151. The controller 110 may determine that the stop float 151 detected rising fluid level when the output from the fluid detection sensor of the stop float changed from "on" to "off."

In 410, if the controller 110 determines that the stop float 151 detected the falling fluid level based on the output from the fluid detection sensor of the stop float 151, the controller 110 may stop the rotation of the first impeller. The fact that the stop float 151 detected the falling fluid level may mean that the drainage in the reservoir 122 is progressing well. Thus, the controller 110 may stop the rotation of the first impeller. As discussed below, if a second impeller, the impeller 200 of the second pump unit 140, is also rotating at operation 408, then in operation 410, the controller 110 may also stop the rotation of the second impeller.

In 412, the controller 110 may determine whether the first impeller and/or the second impeller has been continuously rotating in the same direction for a predetermined time. For example, the timer 310 of the controller 110 may count the duration and signal to the I/O controller 312 the duration. The user may set the predetermined time. For example, the user may use the user interface 306 to set the predetermined time. In some embodiments, the predetermined time may be set between 10 minutes to 60 minutes.

In 414, if the controller 110 determines that the first impeller and/or the second impeller has been continuously rotating in the same direction for the predetermined time, the controller 110 may stop the first impeller and/or the second impeller and activate the impeller(s) 200 to rotate in a reverse direction. The fact that the first impeller and/or the second impeller has been continuously rotating in the same direction for the predetermined time may mean that there may be the potential failure (e.g., tangling, clogging, etc.) with the rotation of the impeller(s) 200. Thus, to address the potential failure, the controller may activate the impeller(s) 200 to rotate in the reverse direction to remove the foreign matter from the impeller(s) 200. Before rotating the impeller 200 in the reverse direction, the controller 110 may stop the impeller 200 rotation to facilitate removal of foreign matter entangled or clogged in the impeller 200 or to protect the motor. For example, the controller 110 may stop the current to the electric motor for a time period set to allow rotation of the impeller 200 to stop before activating the impeller 200 to rotate in a reverse direction after detecting the potential failure. In some embodiments, the time period can be 10 seconds. The time period may be set by the user by using the I/O controller 312.

As mentioned above, the rotation of the impeller may be reversed by reversing a polarity of current delivered to a motor. The current may be single phase or 3-phase AC current. When the current is signal phase AC current, the polarity may be reversed by shifting the current's sinusoidal wave by 180 degrees. In a 3-phase AC current, the polarity may be reversed may reversing or otherwise shifting the sinusoidal waves of the current applied on start up.

In 416, the controller 110 may determine whether the lag float 153 detected rising fluid level based on the output from the fluid detection sensor of the lag float 153. In other words, the controller may determine whether the fluid level in the reservoir 122 reaches a height of the lag float which is greater than the height of the start float. The controller 110 may determine that the lag float 153 detected the rising fluid level when the output from the fluid detection sensor of the lag float 153 changed from "off" to "on." If the controller determines that the lag float 153 did not detect rising fluid level, the operation the operation returns to operation 408.

In 418, if the controller 110 determines that the lag float 153 detected rising fluid level, the controller 110 may activate the second impeller, the impeller 200 of the second pump unit 140, to rotate. The fact that the lag float 153 detected rising fluid level may mean that there may be the potential failure (e.g., tangling, clogging, etc.) with the rotation of the first impeller and the fluid level in reservoir 112 is considerably elevated because the lag float 153 is at a higher height than the start float 152. Thus, to address the potential failure, the controller may 110 activate the second impeller to pump the more fluid. The controller 110 may activate the second impeller to rotate in a reverse direction in which the second impeller was last activated and rotating.

In 420, if the controller 110 determines that the lag float 153 detected rising fluid level, the controller 110 may also stop a rotation of the first impeller and activate the first impeller to rotate in a reverse direction. As explained above, the fact that the lag float 153 detected rising fluid level may mean that there may be the potential failure. Thus, to address the potential failure, the controller may activate the first impeller to rotate in the reverse direction to remove the foreign matter from the first impeller. Before rotating the first impeller in the reverse direction, the controller 110 may stop the rotation of the first impeller to facilitate removal of foreign matter entangled or clogged in the impeller or to protect the electric motor of the first impeller. For example, the controller 110 may stop the current to the electric motor for a time period set to allow rotation of the first impeller to stop before activating the first impeller to rotate in a reverse direction after detecting the potential failure. In some embodiments, the time period can be 10 seconds. The time period may be set by the user by using the I/O controller 312.

After 420, the operation moves back to operation 408 and loops operations 408 through 420 until the controller detects that the stop float detected the falling water level. As such, by detecting potential failure of the impeller 200 to rotate, the pump 100 can take the necessary action to drain more reliably. As explained above, detecting potential failure of the impeller 200 to rotate may include detecting the failure based on the signal from the fluid detection sensor or detecting the failure when the impeller 200 has been continuously rotating for the predetermined time. Detecting the potential failure of the impeller 200 may include detecting other related events. To detect the related events, other types of sensors may be placed on the pump 100. For example, detecting potential failure of the impeller 200 may include detecting the failure when: a temperature sensed by a temperature sensor located in the pump 100 exceeded a predetermined temperature as an overheating, an overload of the components is detected, current drawn by the pump is abnormal, a rotating speed of the impeller 200 lowered a predetermined speed as an insufficient rotating speed, an abnormal vibration pattern of the pump 100 is detected, an abnormal noise pattern of the pump 100 is detected, an abnormal flow speed of the pump 100 is detected, an abnormal discharge pressure of the pump 100 is detected, an abnormal power consumption rate of the pump 100 is detected, an abnormal power factor of the motor is detected, or other events that are indicative of the potential failure of the impeller 200 to rotate are detected.

It is to be appreciated that the Detailed Description section, and not any other section, is intended to be used to interpret the claims. Other sections can set forth one or more but not all exemplary embodiments as contemplated by the inventor(s), and thus, are not intended to limit this disclosure or the appended claims in any way.

While this disclosure describes exemplary embodiments for exemplary fields and applications, it should be understood that the disclosure is not limited thereto. Other embodiments and modifications thereto are possible, and are within the scope and spirit of this disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments can perform functional blocks, steps, operations, methods, etc. using orderings different than those described herein.

References herein to "one embodiment," "an embodiment," "an example embodiment," or similar phrases, indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein. Additionally, some embodiments can be described using the expression "coupled" and "connected" along with their derivatives. These terms are not necessarily intended as synonyms for each other. For example, some embodiments can be described using the terms "connected" and/or "coupled" to indicate that two or more elements are in direct physical or electrical contact with each other. The term "coupled," however, can also mean that two or more elements are not in direct contact with each other, but yet still co-operate or interact with each other.

The breadth and scope of this disclosure should not be limited by any of the above-described exemplary embodiments, but should be defined only in accordance with the following claims and their equivalents.

What is claimed is:

1. A pump, comprising:

an impeller configured to move fluid through the pump in a common direction regardless of which way the impeller rotates;

an electric motor configured to drive the impeller;

a fluid detection sensor positioned to detect a quantity of fluid in a reservoir that the pump is configured to evacuate, a fluid detection sensor comprising a first float sensor and a second float sensor; and a controller is coupled to the fluid detection sensor and is configured to:

based on a signal from the fluid detection sensor, detect a failure of the impeller to rotate, wherein the first float sensor detects a fluid level in the reservoir reaches a first height;

in response to detection of the failure, reverse polarity of current to the electric motor to reverse rotation of the impeller;

detect, by the second float sensor following detection by the first float sensor, a second fluid level that indicates the quantity of fluid in the reservoir is decreasing, wherein the second fluid level is lesser than the first fluid level; and in response to detecting the second fluid level, stop rotation of the impeller.

2. The pump of claim 1, wherein reversing the polarity of the current causes the impeller to rotate in a first direction and wherein the fluid detection sensor further comprises a third float sensor, wherein the controller is configured to activate the impeller to rotate in a second direction opposite the first direction after detecting, by the third float sensor, the fluid level in the reservoir reaches a third height greater than the first height.

3. The pump of claim 2, wherein the impeller is a first impeller, further comprising:

a second impeller configured to move fluid through the pump in a second common direction regardless of which way the second impeller rotates;

a second electric motor configured to drive the second impeller; and wherein the controller is further configured to activate the second impeller to rotate in response to detecting, by the third float sensor, that the fluid level in the reservoir reaches the third height.

4. The pump of claim 1, wherein the controller is further configured to stop the current to the electric motor for a time period set to allow the rotation of the impeller to stop before activating the impeller to rotate in the reverse direction after detecting the failure.

5. The pump of claim 1, wherein the detecting the failure comprises detecting that the impeller has been continuously rotating for a predetermined time.

6. The pump of claim 1, further comprising a grinder connected to a same shaft as the impeller.

7. The pump of claim 1, wherein the electric motor is a three-phase motor and the controller shifts sinusoidal waves of currents of the three-phase motor by 180 degrees to reverse the rotation of the impeller.

8. The pump of claim 1, wherein the pump is configured to move sewage.

9. The pump of claim 1, wherein the controller reverses the polarity to clear debris stuck in the impeller.

10. The pump of claim 1, wherein the impeller has a blade having walls bulging symmetrically from a center of the impeller to push the fluid to a same direction regardless of a direction of rotation of the impeller.

11. The pump of claim 1, wherein the failure is an event selected from an overheating of the pump, an overloading of the pump, abnormal current draw, and an insufficient rotating speed of the impeller.

12. The pump of claim 1, wherein the controller is further configured to:

determine the impeller has rotated in a first direction for a predetermined amount of time; and reverse the polarity of the current to the electric motor to reverse rotation of the impeller.

13. A method for controlling a pump, the method comprising:

driving, by an electric motor, an impeller to move fluid through the pump in a common direction regardless of which way the impeller rotates; and detecting, by a first float sensor, failure of the impeller to rotate, wherein the float sensor detects a fluid level in a reservoir reaches a first height, wherein the pump is configured to evacuate fluid from the reservoir;

in response to detection of the failure, reversing polarity of current to the electric motor to reverse rotation of the impeller;

detecting, by the second float sensor following detection by the first float sensor, a second fluid level that indicates the quantity of fluid in the reservoir is decreasing, wherein the second fluid level is lesser than the first fluid level; and in response to detecting the second fluid level, stopping rotation of the impeller.

14. The method of claim 13, wherein the impeller rotates in a first direction, further comprising:

activating the impeller to rotate in a second direction opposite the first direction after detecting, by a third float sensor, the fluid level in the reservoir reaches a third height greater than the first height.

15. The method of claim 14, wherein the impeller is a first impeller, further comprising:

driving, by a second electric motor, a second impeller to move fluid through the pump in a second common direction regardless of which way the second impeller rotates in response to detecting, by the third fluid sensor, that the fluid level in the reservoir reaches the third height.

16. The method of claim 13, further comprising:

stopping the current to the electric motor for a time period set to allow the rotation of the impeller to stop before activating the impeller to rotate in the reverse direction after detecting the failure.

17. The method of claim 13, wherein the detecting the failure comprises detecting that the impeller has been continuously rotating for a predetermined time.

18. The method of claim 13, further comprising:

driving, by the electric motor, a grinder connected to a same shaft to the impeller.

19. The method of claim 13, wherein the electric motor is a three-phase motor and the controller switches at least two phases of three phases of the current to reverse the rotation of the impeller.

20. The method of claim 13, further comprising:

detecting the impeller had rotated in a first direction for a predetermined amount of time; and reversing the polarity of the current to the electric motor to reverse rotation of the impeller.

* * * * *